US007621439B2

(12) United States Patent
McClure

(10) Patent No.: US 7,621,439 B2
(45) Date of Patent: Nov. 24, 2009

(54) CONTAINER HAVING STACKABLE SHELF ASSEMBLY

(75) Inventor: Jack A McClure, Omaha, NE (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 11/956,159

(22) Filed: Dec. 13, 2007

(65) Prior Publication Data

US 2009/0152335 A1 Jun. 18, 2009

(51) Int. Cl.
*B65D 25/04* (2006.01)

(52) U.S. Cl. ..... 229/120.32; 206/499; 229/120

(58) Field of Classification Search ..... 229/120, 229/120.32, 906, 109, 918; 220/527, 528; 206/499

See application file for complete search history.

(56) References Cited

U.S. PATENT DOCUMENTS 1,142,017 A * 6/1915 Brown ..... 229/120.32
1,901,530 A * 3/1933 Pellymounter ..... 229/120.32
2,163,045 A * 6/1939 Lavere ..... 206/591
2,565,146 A * 8/1951 Okon ..... 229/120.32
2,965,279 A * 12/1960 Campbell ..... 229/915
3,045,888 A * 7/1962 Forrer ..... 229/125.19
5,397,051 A * 3/1995 Liu et al. ..... 229/906
6,752,311 B2 * 6/2004 Tulkoff ..... 229/120
6,851,601 B1 * 2/2005 Montoya ..... 229/120
7,152,777 B2 12/2006 McClure

FOREIGN PATENT DOCUMENTS

EP 576325 A1 * 12/1993 ..... 229/109

* cited by examiner

*Primary Examiner*—Gary E Elkins
(74) *Attorney, Agent, or Firm*—Matthew W. Eslami

(57) ABSTRACT

A container assembly is provided. The container has at least one bottom panel, and at least one side panel extending upwardly from the at least one bottom panel, to form an inner cavity. The bottom panel has at least one vent hole. A blank is provided having a substantially rectangular shape. The blank has flaps extending from corners of the blank. The flaps have tabs extending from an end. The flaps are folded substantially perpendicular to a plane defined by a body of the blank. At least one of the tabs are placed into at least one vent hole in the bottom panel.

3 Claims, 8 Drawing Sheets

CONTAINER HAVING STACKABLE SHELF ASSEMBLY

FIELD OF THE INVENTION

This invention relates generally to shipping and display type containers.

BACKGROUND OF THE INVENTION

It is generally known to ship products. The shipment of certain kinds of products, such as, for example, hot tortilla shells can be problematic. In an example, the tortilla shells can tend to "block" together if under too much pressure. Accordingly, it would be beneficial to have multiple layers of product which are isolated from the weight of other layers above. Previously, only 2 layers of shells could be stacked in a box using a standard U-hoard for separation. Stackable-type shelves were not a good option; since the box ended up so deep they were too time consuming to install. Previous solutions also led to a lack of desirable "corner-blocking" to prevent the tortillas from shifting into a square corner and being subject to damage after freezing. Accordingly, a need exists for a container having a shelving system which allows efficient storage of products.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
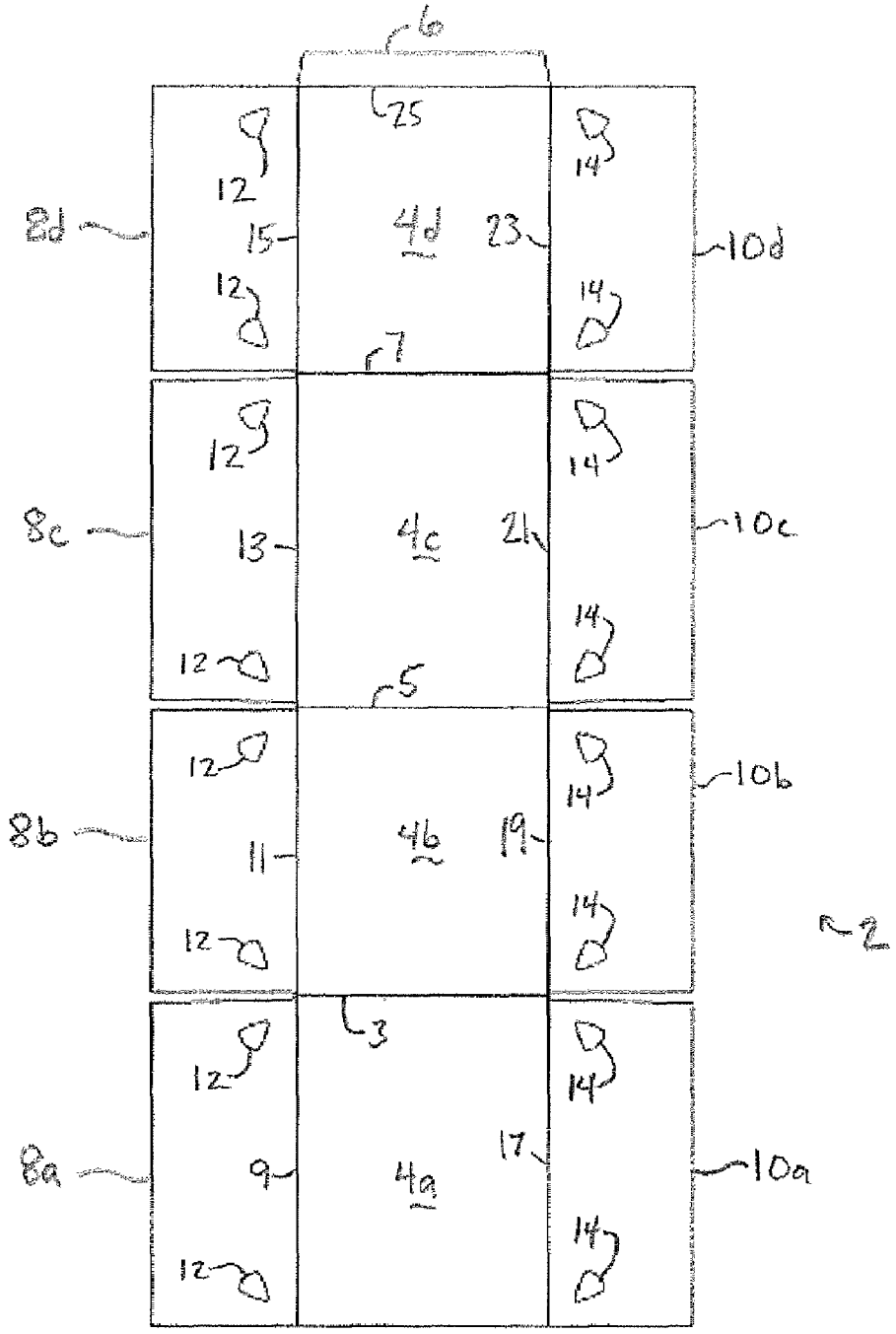
FIG. 1 is a plan view of a container as a flat blank.

The present invention provides a container or box having a stackable shelf assembly. The shelf assembly serially supports an inner-pack shelf upon the shelf immediately below. This assembly can be used for transporting, for example, tortillas or similarly shaped products. The assembly has a container having at least one bottom panel, and at least one side panel extending upwardly from said at least one bottom panel, to form an inner cavity. The bottom panel has at least one vent hole. A blank is provided having a substantially rectangular shape. The blank has flaps extending from corners of the blank. The flaps have tabs extending from an end. The flaps are folded substantially perpendicular to a plane defined by a body of the blank. At least one of the tabs are placed into at least one vent hole in the bottom panel.

The present invention includes a single sheet of foldable material cut and scored to form a blank formable into a container. By way of overview and with reference to FIGS. 1-11, an embodiment of the present invention includes a single piece blank 2 arranged to form a container 100. A blank 20 which forms a stackable shelf 102 is also provided. Specific details of the blanks 2, 20, shelf 102 and container 100 are described with more particularity below.

The present invention will now be described with reference to the accompanying FIGS. 1-11 where like numerals correspond to like elements. In all FIGURES, cut lines are shown as solid lines, score lines or lines of weakness are shown as broken lines. For the purpose of further description herein, the downward direction is defined as the direction perpendicular to bottom panels 10*a*, 10*b*, 10*c*, 10*d* that corresponds to the outer surface of the bottom panels when the container has been erected, and the upward direction is defined as the direction perpendicular to the bottom panels that corresponds to the inner surfaces of the bottom panels when the container has been erected.

The blank 2 and resulting container 100 is typically made from any suitable material used in the shipping, storing or displaying of goods, as are the blank 20 and resulting shelf 102. Suitable, nonlimiting examples of such materials include paperboard, containerboard, cardboard, pasteboard, fiberboard, corrugated containerboard, corrugated paperboard, single wall corrugated containerboard, multiwall corrugated containerboard or a combination thereof.

FIG. 1 illustrates a blank 2 having panels 4*a*, 4*b*, 4*c*, 4*d*. Fold line 3 is provided between side panel 4*a* and side panel 4*b*. Fold line 5 is provided between side panel 4*b* and side panel 4*c*. Fold line 7 is provided between side panel 4*c* and side panel 4*d*. Attached to side panel 4*d* is glue tab panel 6, which is opposite side panel 4*d* along fold line 25. Attached to each of the side panels 4*a*, 4*b*, 4*c*, 4*d* are top panels 8*a*, 8*b*, 8*c*, 8*d*. Top panel 8*a* is attached to side panel 4*a* and is opposite side panel 4*a* along fold line 9. Top panel 8*b* is attached to side panel 4*b* and is opposite side panel 4*b* along fold line 11. Top panel 8*c* is opposite side panel 4*c* along fold line 13. Top panel 8*d* is opposite side panel 4*d* along fold line 15.

Attached to each of the side panels 4*a*, 4*b*, 4*c*, 4*d* are bottom panels 10*a*, 10*b*, 10*c*, 10*d*. Bottom panel 10*a* is opposite side panel 4*a* along fold line 17. Bottom panel 10*b* is opposite side panel 4*b* along fold line 19. Bottom panel 10*c* is opposite side panel 4*c* along fold line 21. Bottom panel 10*d* is opposite side panel 4*d* along fold line 23. Top panels 8*a*, 8*b*, 8*c*, 8*d* may have slits or vent holes 12 located adjacent to fold lines 9, 11, 13, 15, respectively. The vent holes 12 may be symmetrically positioned adjacent the fold lines and may be identical in shape. Similarly, bottom panels 10*a*, 10*b*, 10*c*, 10*d* may have slits or vent holes 14 which are located on the bottom panels adjacent to fold lines 17, 19, 21, 23. The slits 16 may extend, in an embodiment, from the side panels 4*a*, 4*c* to top panels 8*a*, 8*c*, respectively, across each respective fold line 9, 13. Similarly, the slits 16 may extend, in an embodiment, from the side panels 4*a*, 4*c* to bottom panels 10*a*, 10*c* respectively, across each respective fold line 17, 21. Side panels 4*a* and 4*c* may have identical widths. Side panels 4*b* and 4*d* may have identical widths as well. The width of side panel 4*a* may be greater than the width of side panel 4*b*. In addition, the dimensions selected for each of the panels 4, 8, 10 may be those which are contemplated by one of ordinary skill in the art for a given application.

Figure 2:
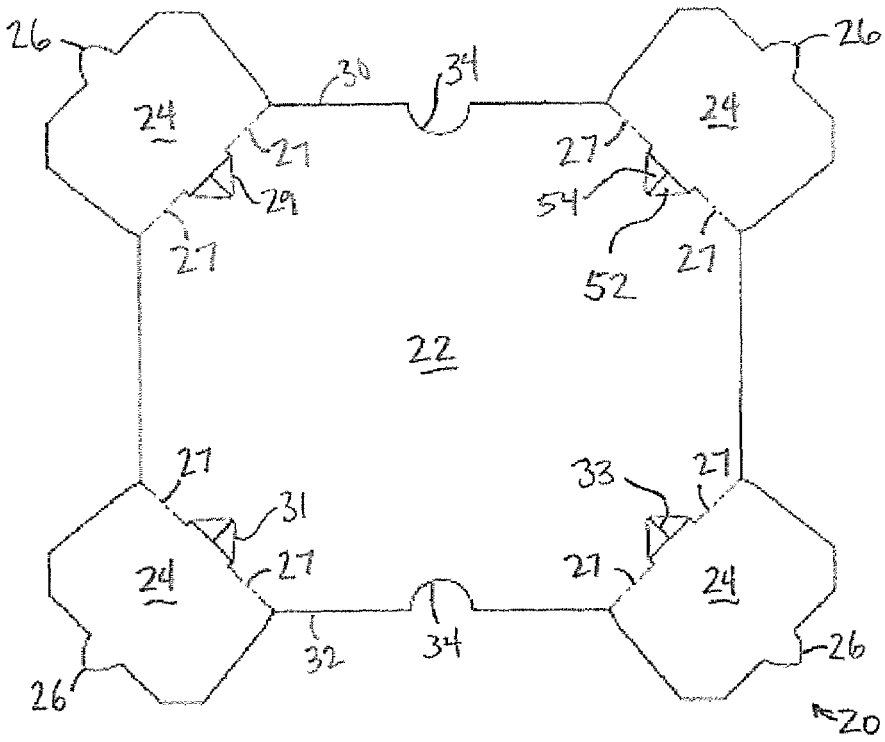
FIG. 2 is a plan view of a shelf as a flat blank.

FIG. 2 illustrates a blank 20 which can be assembled into a stackable shelf 102. The blank 20 has a center panel 22 which is attached to corner flaps 24 opposite fold lines 27. The center panel 22 is substantially rectangular in shape. The corner flaps 24 have a tab 26 which extends from an end opposite the center panel 22. Located adjacent to fold line 27 are diagonal fold lines 29, 31 which meet at an apex. Located between fold lines 29, 31 is score line 33. Located at sides 30, 32 of the center panel 22 are concave sections 34 which are formed within the body of the center panel 22.

The blank 2 may be assembled in a manner similar to conventional four-sided boxes wherein side panels 4*a*, 4*b*, 4*c*, 4*d* are folded at fold lines 3, 5, and 7. Next bottom panels 10*a*, 10*b*, 10*c*, 10*d* may be folded towards the side panels 4*a*, 4*b*, 4*c*, 4*d* at fold lines 17, 19, 21 and 23. Side panel 4*a* may be positioned adjacent to side panel 4*d* wherein tab 6 may be attached to the side panel 4*a* via a fastener, such as glue or other adhesive, or mechanical fasteners, for example.

Figure 3:
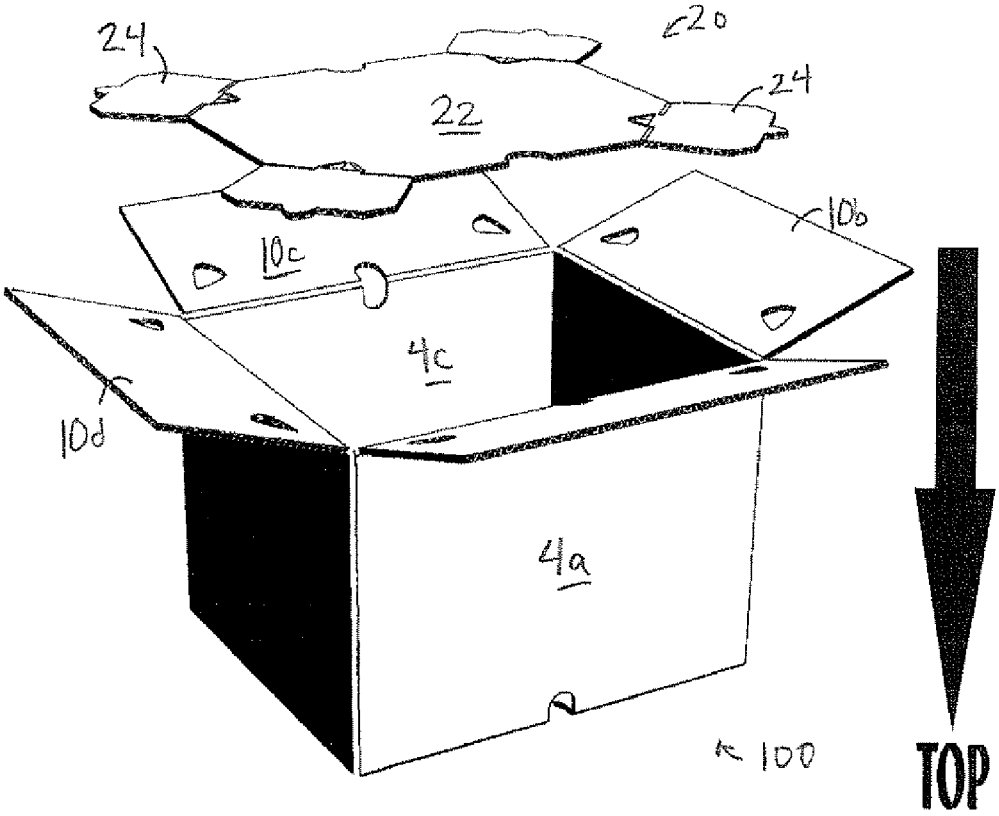
FIG. 3 is a perspective view of the blank of FIG. 2 prior to assembly within a container assembled from the blank of FIG. 1.
Figure 4:
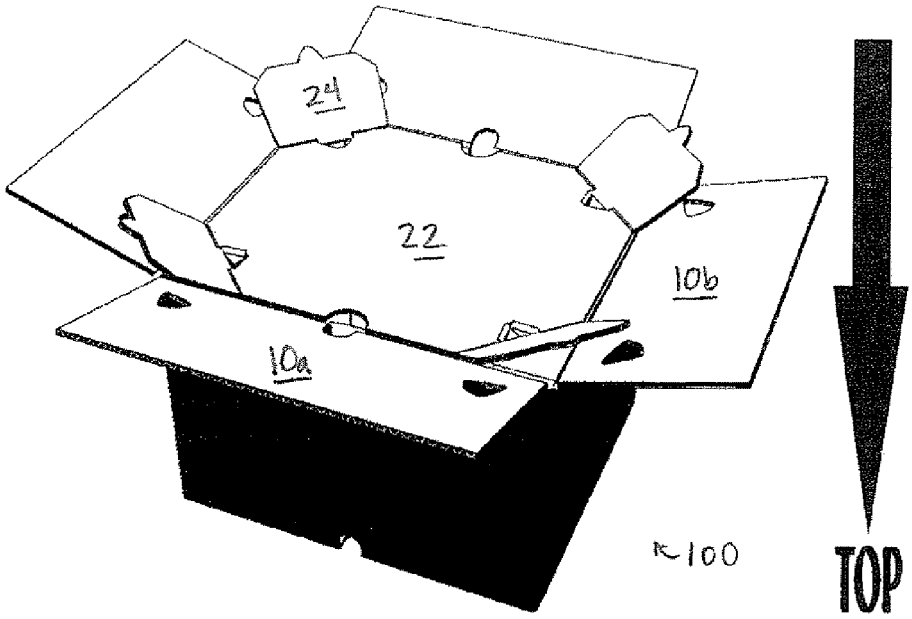
FIG. 4 is a perspective view of the partially erected shelf from the blank of FIG. 2 and the container formed from the blank of FIG. 1.
Figure 5:
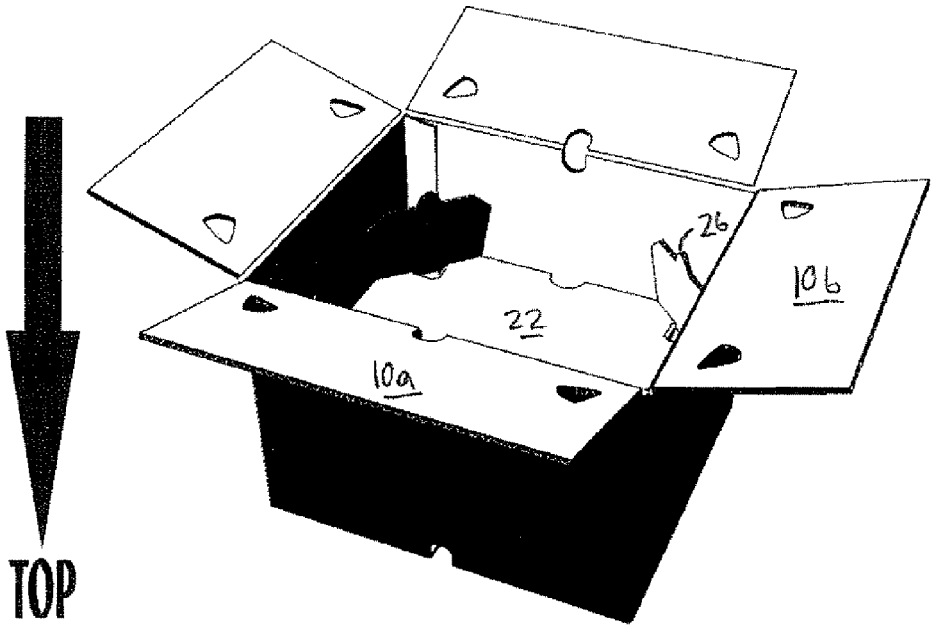
FIG. 5 is yet another perspective view of the partially erected shelf from the blank of FIG. 2 and the container formed from the blank of FIG. 1.

FIG. 3 illustrates the blank 20 positioned above the assembled container 100 made from the blank 2 wherein the blank 20 is being prepared for assembly as a shelf 102 within the container 100. The blank 20 is adjacent the bottom panels 10, 10*b*, 10*c*, 10*d*. The container 100 in this embodiment may be considered as being upside-down, with panels 8*a*, 8*b*, 8*c*, 8*d* being in a closed arrangement. As seen in FIG. 4, corner flaps 24 are folded towards the bottom flaps 10*a*, 10*b*, 10*c*, 10*d* of the container 100 as the blank is placed within the container 100. At this point, a product, such as a package of tortillas, may be placed in the container 100 prior to placement of the blank 20 within the container 100. FIG. 5 illustrates the container 100 having product underneath the shelf 102 in an assembled state, with tabs 26 pointing in a direction toward the bottom panels 10*a*, 10*b*, 10*c*, 10*d*.

Figure 6:
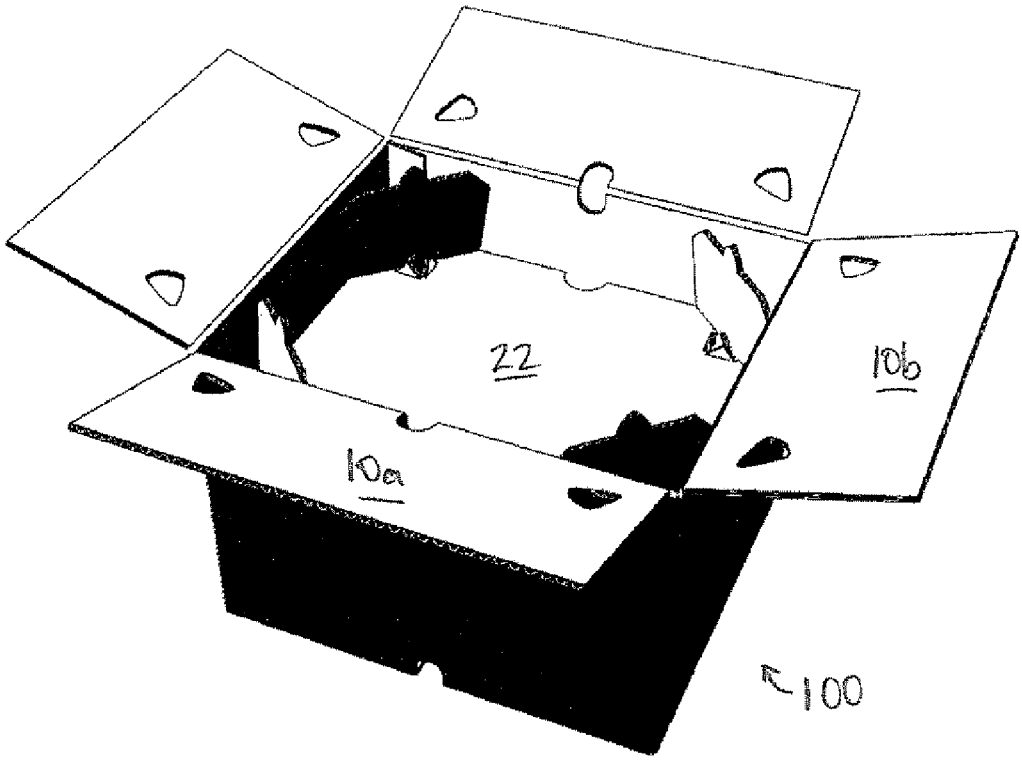
FIG. 6 is yet another perspective view of the partially erected shelf from the blank of FIG. 2 and the container formed from the blank of FIG. 1.
Figure 7:
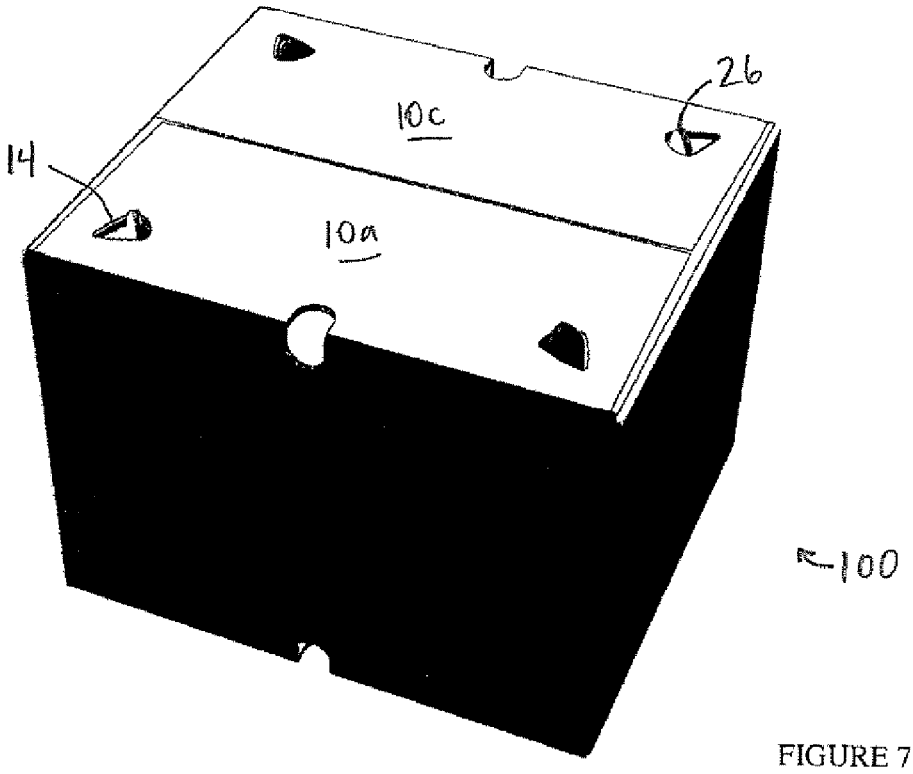
FIG. 7 is a perspective view of a the container formed from the blank of FIG. 1 in a closed state.
Figure 8:
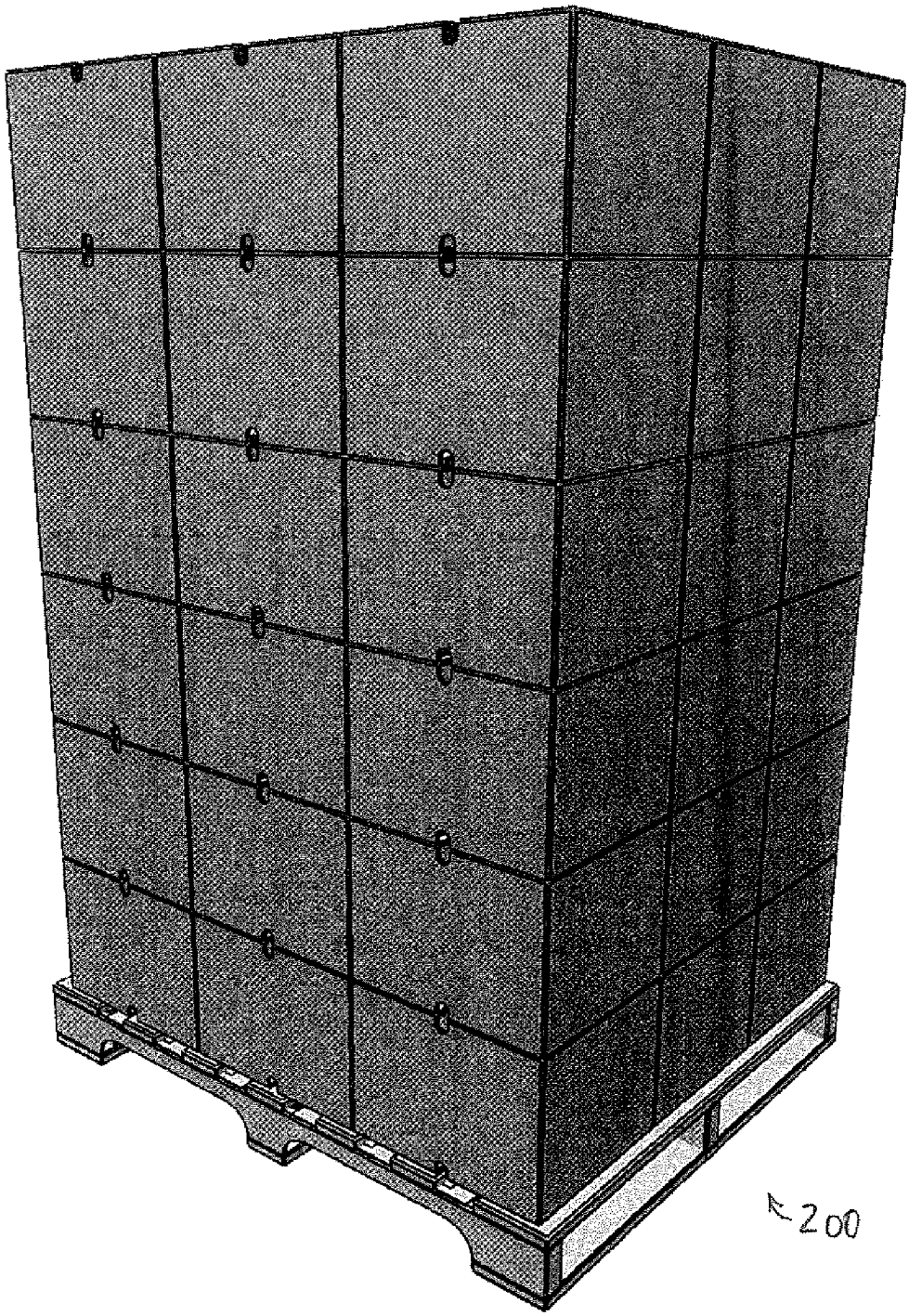
FIG. 8 is a perspective view of a pallet of containers formed from the blank of FIG. 1.

FIG. 6 illustrates the container 100 after more product, such as another tortilla package, is placed on the previously assembled shelf 102, and a second shelf 102 has been placed within the container 100 over the additional product FIG. 7 illustrates the container 100 after another product has been placed within the container 100 on the shelf 102 and panels 10*a*, 10*b*, 10*c*, 10*d* are folded to close the container 100. Tabs 26 may be protruding through the vent holes 14. The container 100 may then be rotated to a "right side up" position and placed onto a pallet 200 illustrated in FIG. 8.

Figure 9:
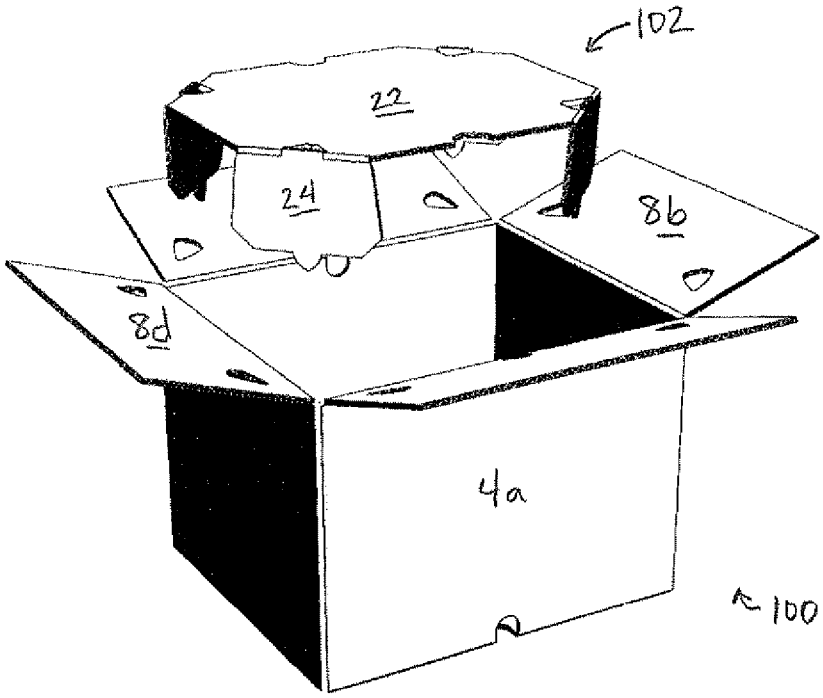
FIG. 9 is a perspective view of the partially erected shelf from the blank of FIG. 2 and the container formed from the blank of FIG. 1 in another embodiment of the present invention.
Figure 10:
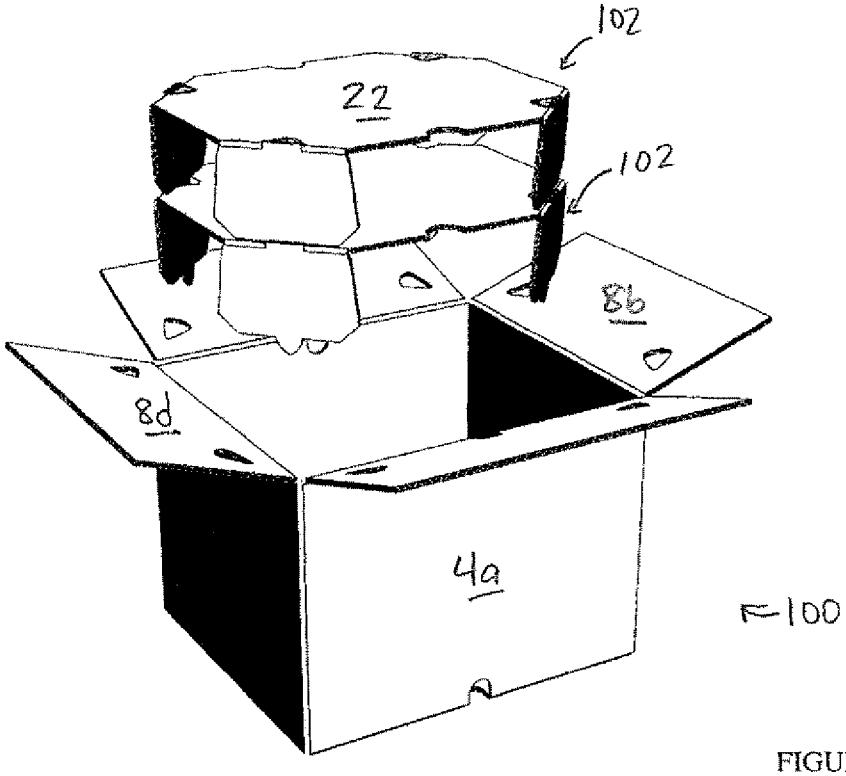
FIG. 10 is a perspective view of three partially erected shelves from the blank of FIG. 2 and the container formed from the blank of FIG. 1 in the embodiment of FIG. 9.
Figure 11:
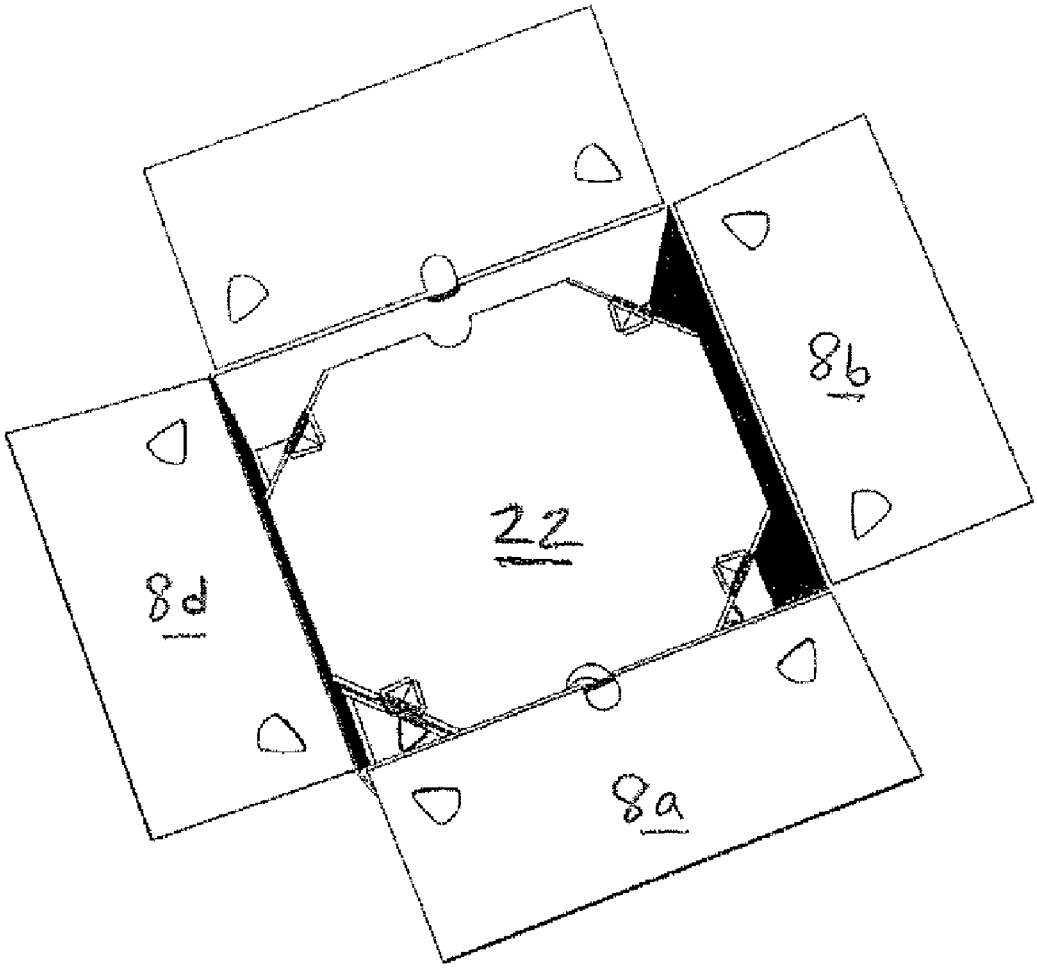
FIG. 11 is a perspective view of the shelves from the blank of FIG. 2 and the container formed from the blank of FIG. 1 in the embodiment of FIG. 9.

In another embodiment, illustrated in FIG. 9, the shelf 102 may be adjacent top panels 8*a*, 8*b*, 8*c*, 8*d* and may have flaps 24 folded toward bottom panels 10*a*, 10*b*, 10*c*, 10*d*. Product is placed on. bottom panels 10*a*, 10*b*, 10*c*, 10*d*, and then is placed on the center panel 22 once the shelf 102 is placed within the container 100. FIG. 10 shows an array of stacked shelves 102. The tabs 26 may fit into slits created by folding sections 52, 54 at fold lines 29, 31. By inserting the tabs 26 into the slits, the tabs 26 may be locked into place. This may prevent the shelf 102 from becoming unassembled during transport within the container 100. The lowermost shelf 102 which is placed within the container 100 has tabs 26 which may lock into vent holes 14 in the bottom panels 10*a*, 10*b*, 10*c*, 10*d*. FIG. 11 illustrates an overhead view of a stacked arrangement of shelves 102 which may have product placed in between each shelf 102. The container 100 may then be completely closed (i.e., panels 8*a*, 8*b*, 8*c*, 8*d* are folded) and placed on a pallet 200.

"Corner block" may be achieved by using an octagonal-shape shelf and locating the tabs 26 from the flaps 24 into the vent holes 14 of the container 100. The flaps 24 are then "reverse-tapered" to force the bottom edges of the flaps 24 inward from the corners of the container 100. The flaps 24 are then convinced into ideal near-columnar locations with the leg below it by the use of tabs 26 with slits created by folding sections 52, 54. Thus, the legs are essentially self-locating, and require no physical manipulation beyond insertion into the box.

Handholds (not shown) allow the container 100 to be easily manipulated by stock personnel or others, individually or in stacks of two or more. While an embodiment of the invention has been illustrated and described, as noted above, many changes can be made without departing from the spirit and scope of the invention. For example, the blank may also include other features specified by the customer, such as the aforementioned hand holds, additional vent holes, grease or moisture barriers and the like without exceeding the scope of the present invention. Accordingly, the scope of the invention is not limited by the disclosure of the preferred embodiment. Instead, the invention should be determined entirely by reference to the claims that follow.

What is claimed is:

1. An assembly comprising:

a container having at least one bottom panel and at least one side panel extending upwardly from said at least one bottom panel to form an inner cavity; wherein the bottom panel has at least one vent hole; and a shelf having a substantially rectangular shape, the shelf having flaps hingedly attached by fold lines to each corner of the shelf and extending diagonally outwardly from each corner of the shelf, wherein each of the flaps has a tab extending from one end thereof;

wherein the flaps are folded substantially perpendicular to a plane defined by a body of the shelf, and wherein at least one of the tabs are placed into said at least one vent hole in the bottom panel.

2. The assembly of claim 1 wherein: the container is formed from at least one of a paperboard, containerboard, cardboard, pasteboard, fiberboard, corrugated containerboard, corrugated paperboard, single wall corrugated containerboard, and multiwall corrugated containerboard.

3. The assembly of claim 1 wherein the blank is formed from at least one of a paperboard, containerboard, cardboard, pasteboard, fiberboard, corrugated containerboard, corrugated paperboard, single wall corrugated containerboard, and multiwall corrugated containerboard.

* * * * *